US008493420B2

(12) United States Patent
Chen et al.

(10) Patent No.: US 8,493,420 B2
(45) Date of Patent: Jul. 23, 2013

(54) DRIVING METHOD OF A LIQUID CRYSTAL SUB-PIXEL

(75) Inventors: Yu-Chieh Chen, Taipei County (TW); Chien-Huang Liao, Hsinchu (TW); Pin-Miao Liu, Hsinchu County (TW)

(73) Assignee: Au Optronics Corporation, Hsinchu (TW)

( * ) Notice: Subject to any disclaimer, the term of this patent is extended or adjusted under 35 U.S.C. 154(b) by 559 days.

(21) Appl. No.: 12/512,011

(22) Filed: Jul. 29, 2009

(65) Prior Publication Data

US 2010/0220124 A1 Sep. 2, 2010

(30) Foreign Application Priority Data

Feb. 27, 2009 (TW) ..... 98106466 A

(51) Int. Cl.
*G09G 5/02* (2006.01)

(52) U.S. Cl.
USPC ..... 345/694; 345/690; 345/89

(58) Field of Classification Search
USPC ..... 345/87–103, 204, 690–694
See application file for complete search history.

(56) References Cited

U.S. PATENT DOCUMENTS

| | | | | |
|---|---|---|---|---|
| 5,604,613 | A * | 2/1997 | Shinjo et al. | 349/147 |
| 6,417,864 | B1 * | 7/2002 | Jones et al. | 345/596 |
| 6,801,220 | B2 | 10/2004 | Greier et al. | |
| 6,965,127 | B2 | 11/2005 | Wu | |
| 7,211,457 | B2 | 5/2007 | Wu | |
| 7,852,302 | B2 | 12/2010 | Chiang et al. | |
| 8,217,879 | B2 | 7/2012 | Chiang et al. | |
| 8,305,316 | B2 | 11/2012 | Irie et al. | |
| 2005/0017991 | A1 * | 1/2005 | Yamazaki et al. | 345/690 |
| 2005/0173737 | A1 | 8/2005 | Wu | |
| 2006/0040419 | A1 * | 2/2006 | Wu | 438/30 |
| 2007/0008476 | A1 * | 1/2007 | Nakanishi et al. | 349/143 |
| 2008/0048999 | A1 | 2/2008 | Chiang et al. | |
| 2009/0153454 | A1 * | 6/2009 | Irie et al. | 345/89 |
| 2011/0037688 | A1 | 2/2011 | Chiang et al. | |

FOREIGN PATENT DOCUMENTS

| | | |
|---|---|---|
| CN | 101297348 | 10/2008 |
| TW | I264587 | 10/2006 |
| TW | 200811563 | 3/2008 |

OTHER PUBLICATIONS

"Office Action of Taiwan counterpart application" issued on Mar. 22, 2013, p. 1-p. 7, in which the listed references (TW200811563, CN101297348, and TWI264587) were cited.

* cited by examiner

*Primary Examiner* — Lun-Yi Lao
*Assistant Examiner* — Md Saiful A Siddiqui
(74) *Attorney, Agent, or Firm* — Jianq Chyun IP Office

(57) ABSTRACT

A driving method for determining target transmittance of a liquid crystal sub-pixel is provided. The liquid crystal sub-pixel has display regions, the liquid crystal sub-pixel displays the target transmittance when liquid crystal voltage applied to each display region is equal to one other and transmittance variation of liquid crystal layer in the liquid crystal sub-pixel is $S_0$ when variation of LC voltage $\Delta V_{LC}$ occurs. The driving method includes selecting LC voltages in accordance with the target transmittance and area ratio of each display region; and applying each LC voltage to one of the display regions correspondingly, wherein transmittance of each display region is different from the target transmittance, the target transmittance is equal to sum of product of area ratio and transmittance of each display region, and transmittance variation of the liquid crystal layer in the liquid crystal sub-pixel is lower than $S_0$ when variation of LC voltage $\Delta V_{LC}$ occurs.

21 Claims, 3 Drawing Sheets

DRIVING METHOD OF A LIQUID CRYSTAL SUB-PIXEL

CROSS-REFERENCE TO RELATED APPLICATION

This application claims the priority benefit of Taiwan application serial no. 98106466, filed on Feb. 27, 2009. The entirety of the above-mentioned patent application is hereby incorporated by reference herein and made a part of specification.

BACKGROUND OF THE INVENTION

1. Field of the Invention

The present invention relates to a driving method of a liquid crystal sub-pixel. More particularly, the present invention relates to a driving method of a liquid crystal sub-pixel capable of reducing image sticking problem.

2. Description of Related Art

Due to the superior characteristics of high picture quality, good space utilization, low power consumption, and radiation free, liquid crystal displays has gradually become the mainstream products of display device in the market. Inevitably, charged impurities or ions exist in liquid crystal molecules of the liquid crystal display panel. After a long time operation, distribution of charged impurities or ions is gradually changed and results in deterioration of display quality of the liquid crystal display panel. Specifically, during a long time operation, charged impurities or ions may separate in accordance with polarity thereof After charged impurities or ions are separated in accordance with polarity thereof, the LC voltage $V_{LC}$ applied to the liquid crystal layer is reduced by the charged impurities or ions. Accordingly, variation of LC voltage $V_{LC}$ applied to the liquid crystal layer occurs. The phenomenon is so-call screen effect. Additionally, after charged impurities or ions separated in accordance with polarity thereof, a parasitic potential is generated within the liquid crystal bulk panel and the optimum voltage level of common electrode may vary (V-com shift phenomenon).

Since charged impurities or ions in the liquid crystal layer lead to screen effect and V-com shift phenomenon, image sticking problem (or surface-type image sticking problem) may occur. Accordingly, display quality of the liquid crystal display panel is deteriorated. In order to reduce image sticking problem resulted from charged impurities or ions, more reliable liquid crystal materials or modified fabrication processes are currently adopted to reduce quantity of charged impurities or ions. In addition, image sticking problem may also reduced by modified driving method of the liquid crystal display panel. However, image sticking problem can not significantly reduced by the above-mentioned solutions.

SUMMARY OF THE INVENTION

A driving method of a liquid crystal sub-pixel, of which is divided into display regions in the number of n, is provided. For any displayed gray level, the transmittance of a liquid crystal layer within the liquid crystal sub-pixel shall have corresponding transmittance $T_{sub\text{-}pixel}$. As the number of display region n in one sub-pixel is 1, the corresponding voltage applied to the display regions is $V_0$. and transmittance variation of the liquid crystal layer in the liquid crystal sub-pixel is $S_0$ when variation of liquid crystal voltage $\Delta V_{LC}$ occurs. As the number of display region n is larger than 1, the driving method of the liquid crystal sub-pixel includes applying a liquid crystal voltage $V_k$ to each of the display regions respectively so that transmittance of the liquid crystal layer within each of the display regions is $T_k(V_k)$, wherein $1 \leqq k \leqq n$ and $n \geqq 2$. Area of each of the display regions is $a_k$ such that $a_k$ and $T_k(V_k)$ satisfy equation (1);

$$T_{pixel} = \frac{\sum_{k=1}^{n} a_k \times T_k(V_k)}{\sum_{k=1}^{n} a_k}; \tag{1}$$

$$S_{pixel} = \frac{\sum_{k=1}^{n} a_k \times S_k(V_k)}{\sum_{k=1}^{n} a_k} < S_0; \tag{2}$$

When liquid crystal voltage of each of the display regions satisfies equation (1) and variation of liquid crystal voltage $\Delta V_{LC}$ occurs, transmittance variation of the liquid crystal layer in each of the display regions is $S_k(V_k)$, an overall transmittance variation of the liquid crystal layer in the liquid crystal sub-pixel is $S_{pixel}$, as well as $S_k(V_k)$ and $S_{pixel}$ satisfy equation (2).

In an embodiment of the invention, transmittance $T_k(V_k)$ of the liquid crystal layer within parts of the display regions is greater than $T_{sub\text{-}pixel}$, transmittance $T_k(V_k)$ of the liquid crystal layer within the other parts of the display regions is lower than $T_{sub\text{-}pixel}$.

A driving method of a liquid crystal sub-pixel having display regions in the number of n is provided, wherein luminance of gray-level of the liquid crystal sub-pixel is $L_{pixel}$ when the voltage applied to each of the display regions is $V_0$ and luminance of gray-level variation of the liquid crystal sub-pixel is $X_0$ when variation of liquid crystal voltage $\Delta V_{LC}$ occurs. The driving method of the liquid crystal sub-pixel includes applying a liquid crystal voltage $V_k$ to each of the display regions respectively such that luminance of gray-level of each of the display regions is $L_k(V_k)$, wherein $1 \leqq k \leqq n$ and $n \geqq 2$. Area of each of the display regions is $a_k$ such that $a_k$ and $L_k(V_k)$ satisfy equation (3);

$$L_{pixel} = \frac{\sum_{k=1}^{n} a_k \times L_k(V_k)}{\sum_{k=1}^{n} a_k}; \tag{3}$$

$$X_{pixel} = \frac{\sum_{k=1}^{n} a_k \times X_k(V_k)}{\sum_{k=1}^{n} a_k} < X_0; \tag{4}$$

when liquid crystal voltage of each of the display regions satisfies equation (3) and variation of liquid crystal voltage $\Delta V_{LC}$ occurs, luminance of gray-level variation of each of the display regions is $X_k(V_k)$, an overall luminance of gray-level variation of the liquid crystal layer in the liquid crystal sub-pixel is $X_{pixel}$, as well as $X_k(V_k)$ and $X_{pixel}$ satisfy equation (4).

In an embodiment of the invention, luminance of gray-level $L_k(V_k)$ of parts of the display regions is greater than $L_{pixel}$, luminance of gray-level $L_k(V_k)$ of the other parts of the display regions is lower than $L_{pixel}$.

In an embodiment of the invention, liquid crystal voltages $V_1, V_2, \ldots, V_{n-1}$, and $V_n$ applied to each of the display regions are different from one another, or not identical.

In an embodiment of the invention, areas $a_1, a_2, \ldots, a_{n-1}$, and $a_n$ of each of the display regions are different from one another, identical, or not identical.

In an embodiment of the invention, the liquid crystal sub-pixel includes a transmissive liquid crystal sub-pixel, reflective liquid crystal sub-pixel, or a transflective liquid crystal sub-pixel.

In an embodiment of the invention, voltage-transmittance curve of liquid crystal layer within the display regions is different from one another, identical, or not identical.

A driving method for determining a target transmittance of a liquid crystal layer in a liquid crystal sub-pixel is provided, wherein the liquid crystal sub-pixel has a plurality of display regions, the liquid crystal layer in the liquid crystal sub-pixel displays the target transmittance when liquid crystal voltage applied to each of the display regions is equal to one other and transmittance variation of liquid crystal layer in the liquid crystal sub-pixel is $S_0$ when variation of liquid crystal voltage $\Delta V_{LC}$ occurs. The driving method includes: selecting a plurality of liquid crystal voltages in accordance with the target transmittance and area ratio of each of the display regions; and applying each of the liquid crystal voltages to one of the display regions correspondingly, wherein transmittance of each of the display regions is different from the target transmittance, the target transmittance is equal to sum of product of area ratio and transmittance of each display region, and transmittance variation of the liquid crystal layer in the liquid crystal sub-pixel is lower than $S_0$ when variation of liquid crystal voltage $\Delta V_{LC}$ occurs.

A driving method for determining a target luminance of gray-level of a liquid crystal sub-pixel is provided, wherein the liquid crystal sub-pixel has a plurality of display regions, the liquid crystal sub-pixel displays the target luminance of gray-level when liquid crystal voltage applied to each of the display regions is equal to one other and luminance of gray-level variation of the liquid crystal sub-pixel is $X_0$ when variation of liquid crystal voltage $\Delta V_{LC}$ occurs. The driving method includes: selecting a plurality of liquid crystal voltages in accordance with the target luminance of gray-level and area ratio of each of the display regions; and applying each of the liquid crystal voltages to one of the display regions correspondingly, wherein luminance of gray-level of each of the display regions is different from the target luminance of gray-level, the target luminance of gray-level is equal to sum of product of area ratio and gray-level of each display region, and luminance of gray-level variation of the liquid crystal sub-pixel is lower than $X_0$ when variation of liquid crystal voltage $\Delta V_{LC}$ occurs.

Since the present invention selects liquid crystal voltages in accordance with the target luminance of gray-level (or the target transmittance) to be displayed and area ratio of each display region in the liquid crystal sub-pixel and applies each liquid crystal voltage to one of the display regions correspondingly, the liquid crystal sub-pixel is capable of displaying the target luminance of gray-level (or the target transmittance) correctly and is not sensitive to variation of liquid crystal voltage. Accordingly, image sticking problem is effectively reduced.

In order to make the aforementioned and other features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

In order to improve the reliability of display quality of the liquid crystal display panel, a plurality of individual display regions are defined in a liquid crystal sub-pixel and proper liquid crystal voltages are applied to the display regions correspondingly such that the liquid crystal sub-pixel can display correct transmittance. From another aspect, in an embodiment of the invention, a plurality of individual display regions are defined in a liquid crystal sub-pixel and proper liquid crystal voltages are applied to the display regions correspondingly such that the liquid crystal sub-pixel can display correct gray-level. Here, the above-mentioned liquid crystal sub-pixel is a red sub-pixel, a green sub-pixel, blue sub-pixel, white sub-pixel, or other types of sub-pixels. In addition, the above-mentioned liquid crystal sub-pixel is a transmissive liquid crystal sub-pixel, a reflective liquid crystal sub-pixel, or a transflective liquid crystal sub-pixel. For example, the display mode of the liquid crystal sub-pixel is TN-mode, VA-mode, IPS-mode, or OCB-mode. In addition, according to physical properties of the liquid crystal layer in the liquid crystal sub-pixel, the liquid crystal layer may be classified into normally white liquid crystal and normally black liquid crystal. The type and display mode of the liquid crystal sub-pixel is not limited in the present invention. Additionally, physical properties of the liquid crystal layer in the liquid crystal sub-pixel are not limited in the present invention.

When determining liquid crystal voltages applied to the display regions, the liquid crystal voltages are selected to reduce variation of transmittance resulted from variation of liquid crystal voltage applied to each display region. The selection of liquid crystal voltages applied to the display regions is illustrated in the following embodiments.

The First Embodiment

Figure 1:
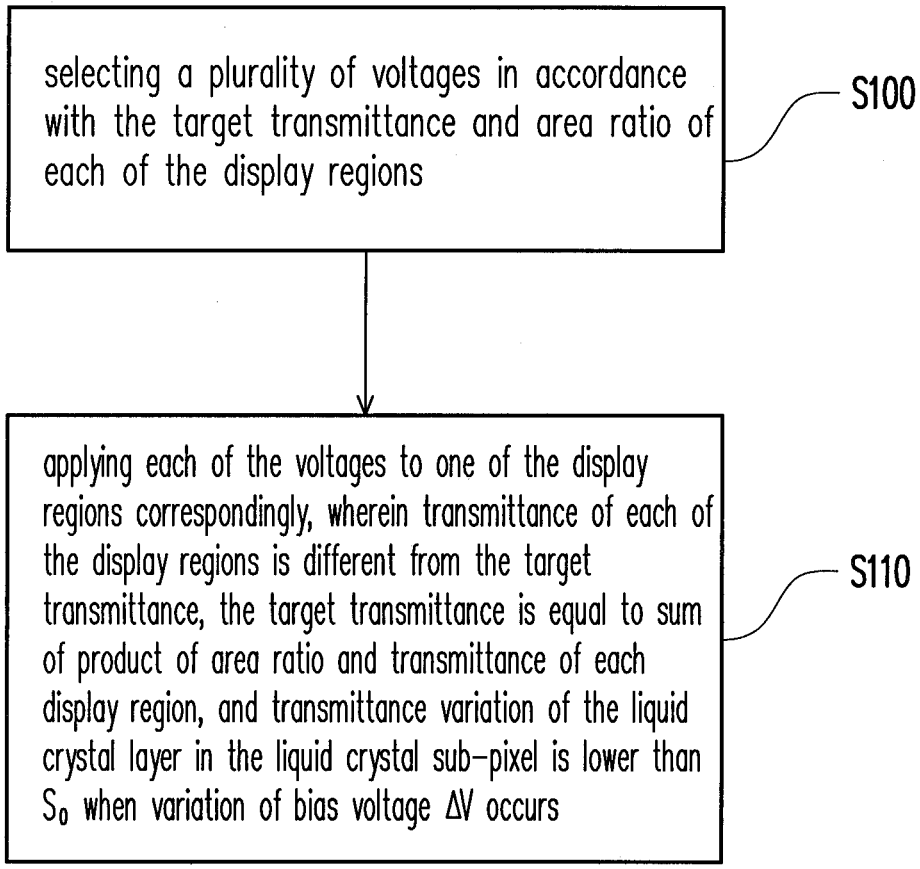
FIG. 1 is a flow chart illustrating a driving method according to the first embodiment of the present invention.

FIG. 1 is a flow chart illustrating a driving method according to the first embodiment of the present invention. Referring to FIG. 1, a driving method of this embodiment is suitable for determining a target transmittance $T_{target}(n)$ to be displayed by a liquid crystal layer in a liquid crystal sub-pixel, wherein the liquid crystal sub-pixel has a plurality of individual display regions, the liquid crystal layer in the liquid crystal sub-pixel displays the target transmittance $T_{target}(n)$ when liquid crystal voltage applied to each of the display regions is equal to one other and transmittance variation of liquid crystal layer in the liquid crystal sub-pixel is $S_0$ when variation of liquid crystal voltage $\Delta V_{LC}$ occurs. Here, liquid crystal voltage $\Delta V_{LC}$ is resulted from charged impurities or ions existed in the liquid crystal layer.

The driving method of the present invention includes the following steps. First, a plurality of liquid crystal voltages are selected in accordance with the target transmittance $T_{target}(n)$ and area ratio of each of the display regions (step S100). Then, each of the liquid crystal voltages is applied to one of the display regions correspondingly, wherein transmittance provided by each of the display regions is different from the target transmittance $T_{target}(n)$ (step S110). The target transmittance $T_{target}(n)$ is equal to sum of product of area ratio and transmittance of each display region, and transmittance variation of the liquid crystal layer in the liquid crystal sub-pixel is lower than $S_0$ when variation of liquid crystal voltage $\Delta V_{LC}$ occurs.

Specifically, the liquid crystal sub-pixel of the present embodiment has display regions in the number of n, wherein transmittance of a liquid crystal layer within the liquid crystal sub-pixel is $T_{sub\text{-}pixel}$ when voltage applied to each of the display regions is $V_0$ and transmittance variation of the liquid crystal sub-pixel is $S_0$ when variation of liquid crystal voltage $\Delta V_{LC}$ occurs. Here, transmittance of a liquid crystal layer within the liquid crystal sub-pixel $T_{sub\text{-}pixel}$ is substantially equal to the target transmittance $T_{target}(n)$. For example, in liquid crystal display panel of LCD-TV, gamma value (γ) is generally equal to 2.2. In addition, in liquid crystal display panels having 8-bits image processor, the target transmittance $T_{target}(n)$ is related to gray-level and gamma value (γ). The relationship is expressed as following.

$$T_{pixel} = T_{target}(n) = \left(\frac{n}{255}\right)^{\gamma}$$

In the present embodiment, the driving method includes applying a liquid crystal voltage $V_k$ to each of the display regions respectively such that transmittance of the liquid crystal layer within each of the display regions is $T_k(V_k)$, wherein $1 \leqq k \leqq n$ and $n \geqq 2$. Area of each of the display regions is $a_k$ such that $a_k$ and $T_k(V_k)$ satisfy equation (1). In other words, the liquid crystal sub-pixel can display correct transmittance $T_{sub\text{-}pixel}$ or $T_{target}(n)$ when $a_k$ and $T_k(V_k)$ satisfy equation (1). As shown in equation (1), the target transmittance $T_{target}(n)$ is equal to sum of product of area $a_k$ and transmittance $T_k(V_k)$ of each display region.

$$T_{pixel} = \frac{\sum_{k=1}^{n} a_k \times T_k(V_k)}{\sum_{k=1}^{n} a_k} \tag{1}$$

$$S_{pixel} = \frac{\sum_{k=1}^{n} a_k \times S_k(V_k)}{\sum_{k=1}^{n} a_k} < S_0 \tag{2}$$

When liquid crystal voltage of each of the display regions satisfies equation (1) and variation of liquid crystal voltage $\Delta V_{LC}$ occurs, transmittance variation of each of the display regions is $S_k(V_k)$, an overall transmittance variation of the liquid crystal layer in the liquid crystal sub-pixel is $S_{pixel}$, as well as $S_k(V_k)$ and $S_{pixel}$ satisfy equation (2). As shown in equation (2), when variation of liquid crystal voltage $\Delta V_{LC}$ occurs, the overall transmittance variation $S_{pixel}$ is equal to sum of product of area $a_k$ and transmittance variation $S_k(V_k)$ of each display region. The overall transmittance variation $S_{pixel}$ is lower than the transmittance variation $S_0$.

In an embodiment of the invention, transmittance $T_k(V_k)$ of the liquid crystal layer within some parts of the display regions is greater than $T_{sub\text{-}pixel}$, transmittance $T_k(V_k)$ of the liquid crystal layer within the other parts of the display regions is lower than $T_{sub\text{-}pixel}$. In addition, liquid crystal voltages $V_k$ (i.e. $V_1, V_2, \ldots, V_{n-1}$, and $V_n$) applied to each of the display regions are different from one another, or not identical. It is noted that the driving method does not exclude applied identical liquid crystal voltages $V_k$ (i.e. $V_1, V_2, \ldots, V_{n-1}$, and $V_n$) to each of the display regions. In other words, the driving method which applied different liquid crystal voltages $V_k$ to each of the display regions and the driving method which applied identical liquid crystal voltages $V_k$ to each of the display regions can be adopted alternately when driving liquid crystal sub-pixels.

In an embodiment of the invention, areas $a_k$ (i.e. $a_1, a_2, \ldots, a_{n-1}$, and $a_n$) of each of the display regions are different from one another, identical, or not identical. Additionally, in the present embodiment, voltage-transmittance curve of liquid crystal layer within the display regions are different from one another, identical, or not identical. According to experimental results and voltage-transmittance curve of liquid crystal layer, when liquid crystal voltage $\Delta V_{LC}$ applied to a display region varies 1 mV (i.e. $\Delta V_{LC}$=1 mV), transmittance variation $S_k(V_k)$ is lower than 0.25%. In other words, transmittance variation $S_k(V_k)$ is lower than 0.0025/mV.

Figure 2:
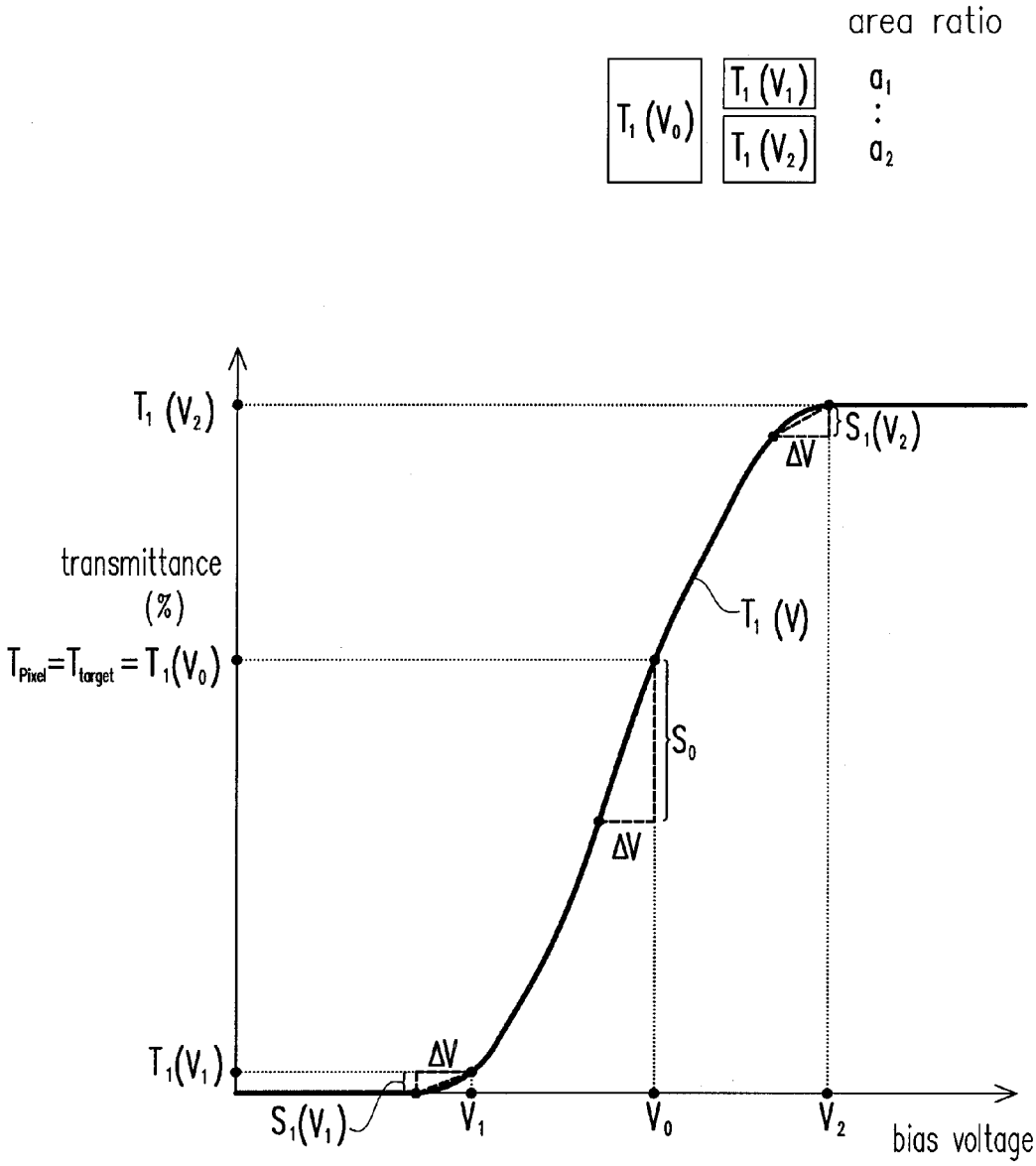
FIG. 2 is a Voltage-Transmittance curve illustrating relationship between voltage $V_0$ and liquid crystal voltages $V_k$ (i.e. liquid crystal voltage $V_1$ and liquid crystal voltage $V_2$).

FIG. 2 is a Voltage-Transmittance curve illustrating relationship between voltage $V_0$ and liquid crystal voltages $V_k$ (i.e, liquid crystal voltage $V_1$ and liquid crystal voltage $V_2$). Referring to FIG. 2, a normally black liquid crystal is described for illustration, wherein Voltage-Transmittance curves of the liquid crystal layer in every display regions are identical.

As shown in FIG. 2, voltage $V_0$ is between liquid crystal voltage $V_1$ and liquid crystal voltage $V_2$. In the present embodiment, liquid crystal voltage $V_1$ and liquid crystal voltage $V_2$ satisfy equation (1) and equation (2). In addition, liquid crystal voltage $V_1$ may be a liquid crystal voltage corresponding to the lowest transmittance (e.g. 0%), liquid crystal voltage $V_2$ may be a liquid crystal voltage corresponding to the highest transmittance (e.g. 100%).

When n=2 and a1≠a2, equation (1) and equation (2) are simplified as followings:

$$T_{pixel} = \frac{a_1 \times T_1(V_1) + a_2 \times T_1(V_2)}{a_1 + a_2} = \left(\frac{a_1}{a_1 + a_2}\right) \times T_1(V_1) + \left(\frac{a_2}{a_1 + a_2}\right) \times T_1(V_2)$$

$$S_{pixel} = \frac{a_1 \times S_1(V_1) + a_2 \times S_1(V_2)}{a_1 + a_2} = \left(\frac{a_1}{a_1 + a_2}\right) \times S_1(V_1) + \left(\frac{a_2}{a_1 + a_2}\right) \times S_1(V_2) < S_0$$

$$\frac{a_1}{a_1 + a_2} \text{ and } \frac{a_2}{a_1 + a_2}$$

represent area ratio of two display regions respectively, while $T_1(V_1$ and $T_1(V_2)$ represent transmittance corresponding to liquid crystal voltage $V_1$ and liquid crystal voltage $V_2$ respectively.

When n=2 and a1=a2, equation (1) and equation (2) are further simplified as followings:

$$T_{pixel} = \frac{T_1(V_1) + T_1(V_2)}{2}$$

$$S_{pixel} = \frac{S_1(V_1) + S_1(V_2)}{2} < S_0$$

The Second Embodiment

Referring to equation (1) and equation (2) described in the first embodiment, when n=2, a1≠a2, and Voltage-Transmittance curves of the liquid crystal layer in every display regions are not identical, equation (1) and equation (2) are simplified as followings:

$$T_{pixel} = \frac{a_1 \times T_1(V_1) + a_2 \times T_2(V_2)}{a_1 + a_2} = \left(\frac{a_1}{a_1 + a_2}\right) \times T_1(V_1) + \left(\frac{a_2}{a_1 + a_2}\right) \times T_2(V_2)$$

$$S_{pixel} = \frac{a_1 \times S_1(V_1) + a_2 \times S_2(V_2)}{a_1 + a_2} = \left(\frac{a_1}{a_1 + a_2}\right) \times S_1(V_1) + \left(\frac{a_2}{a_1 + a_2}\right) \times S_2(V_2) < S_0$$

$$\frac{a_1}{a_1 + a_2} \text{ and } \frac{a_2}{a_1 + a_2}$$

represent area ratio of two display regions respectively, while $T_1(V_1)$ and $T_2(V_2)$ represent transmittance corresponding to liquid crystal voltage $V_1$ and liquid crystal voltage $V_2$ respectively.

When n=2, a1=a2, and Voltage-Transmittance curves of the liquid crystal layer in every display regions are not identical, equation (1) and equation (2) are simplified as followings:

$$T_{pixel} = \frac{T_1(V_1) + T_2(V_2)}{2}$$

$$S_{pixel} = \frac{S_1(V_1) + S_2(V_2)}{2} < S_0$$

As shown in the present embodiment, Voltage-Transmittance curves of the liquid crystal layer in display regions are not identical because structural designs of display regions are not identical. The concept of the present invention is still applied when Voltage-Transmittance curves of the liquid crystal layer in display regions are not identical.

The Third Embodiment

Since transmittance of liquid crystal layer in liquid crystal sub-pixel and luminance of gray-level displayed by liquid crystal sub-pixel is related, the present embodiment selects liquid crystal voltages applied to display regions in accordance with luminance of gray-level and variation of luminance of gray-level.

Figure 3:
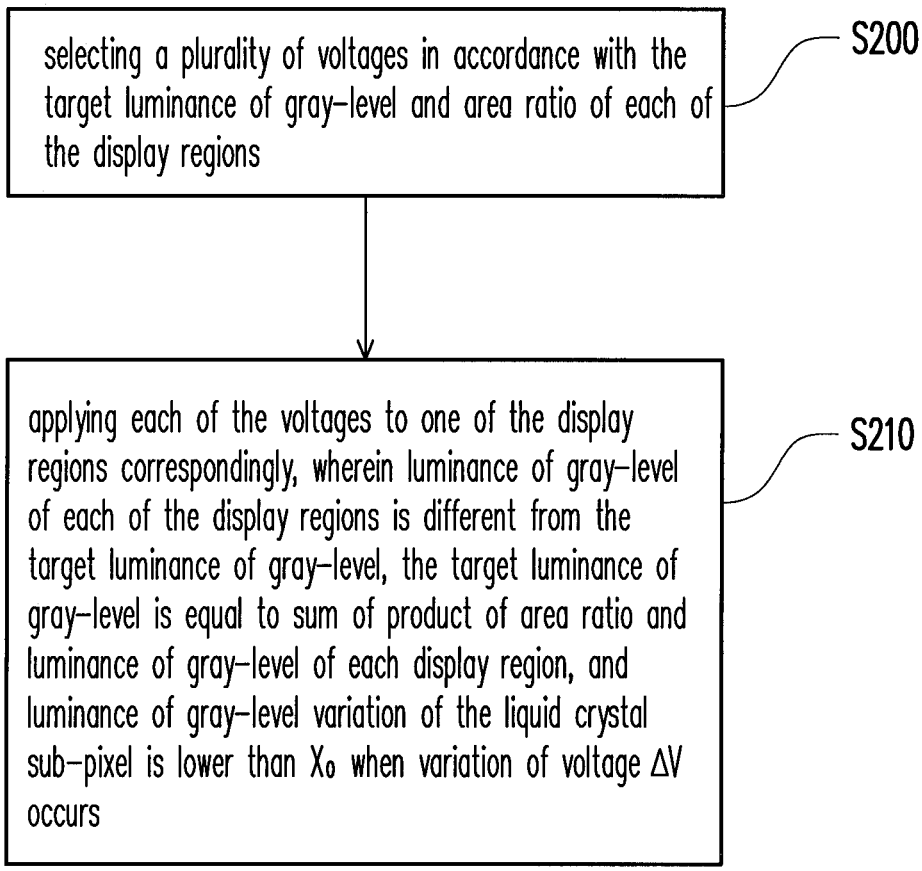
FIG. 3 is a flow chart illustrating a driving method according to the third embodiment of the present invention.

FIG. 3 is a flow chart illustrating a driving method according to the third embodiment of the present invention. Referring to FIG. 3, a driving method of this embodiment is suitable for determining a target luminance of gray-level $L_{target}$(n) to be displayed by a liquid crystal sub-pixel, wherein the liquid crystal sub-pixel has a plurality of individual display regions, the liquid crystal layer in the liquid crystal sub-pixel displays the target luminance of gray-level $L_{target}$(n) when liquid crystal voltage applied to each of the display regions is equal to one other and luminance of gray-level variation of the liquid crystal sub-pixel is $X_0$ when variation of liquid crystal voltage $\Delta V_{LC}$ occurs. Here, liquid crystal voltage $\Delta V_{LC}$ is resulted from charged impurities or ions existed in the liquid crystal layer.

The driving method of the present invention includes the following steps. First, a plurality of liquid crystal voltages are selected in accordance with the target luminance of gray-level $L_{target}$(n) and area ratio of each of the display regions (step S200). Then, each of the liquid crystal voltages is applied to one of the display regions correspondingly, wherein luminance of gray-levle provided by each of the display regions is different from the target luminance of gray-level $L_{target}$(n) (step S210). The target luminance of gray-level $L_{target}$(n) is equal to sum of product of area ratio and transmittance of each display region, and transmittance variation of the liquid crystal layer in the liquid crystal sub-pixel is lower than $X_0$ when variation of liquid crystal voltage $\Delta V_{LC}$ occurs.

Specifically, the liquid crystal sub-pixel of the present embodiment has display regions in the number of n, wherein luminance of gray-level of the liquid crystal sub-pixel is $L_{pixel}$ when voltage applied to each of the display regions is $V_0$ and luminance of gray-level variation of the liquid crystal sub-pixel is $X_0$ when variation of liquid crystal voltage $\Delta V_{LC}$ occurs. Here, luminance of gray-level of the liquid crystal sub-pixel $L_{pixel}$ is substantially equal to the target luminance of gray-level $L_{target}$(n).

In the present embodiment, the driving method includes applying a liquid crystal voltage $V_k$ to each of the display regions respectively such that luminance of gray-level of each of the display regions is $L_k(V_k)$, wherein $1 \leqq k \leqq n$ and $n \geqq 2$. Area of each of the display regions is $a_k$ such that $a_k$ and $L_k(V_k)$ satisfy equation (3). In other words, the liquid crystal sub-pixel can display correct luminance of gray-level $L_{pixel}$ or $L_{target}$(n) when $a_k$ and $L_k(V_k)$ satisfy equation (3). As shown in equation (3), the target luminance of gray-level $L_{target}$(n) is equal to sum of product of area $a_k$ and luminance of gray-level $L_k(V_k)$ of each display region.

$$L_{pixel} = \frac{\sum_{k=1}^{n} a_k \times L_k(V_k)}{\sum_{k=1}^{n} a_k} \tag{3}$$

$$X_{pixel} = \frac{\sum_{k=1}^{n} a_k \times X_k(V_k)}{\sum_{k=1}^{n} a_k} < X_0 \tag{4}$$

when liquid crystal voltage of each of the display regions satisfies equation (3) and variation of liquid crystal voltage $\Delta V_{LC}$ occurs, luminance of gray-level variation of each of the display regions is $X_k(V_k)$, an overall luminance of gray-level variation of the liquid crystal layer in the liquid crystal sub-pixel is $X_{pixel}$, as well as $X_k(V_k)$ and $X_{pixel}$ satisfy equation (4). As shown in equation (4), when variation of liquid crystal voltage $\Delta V_{LC}$ occurs, the overall luminance of gray-level variation $X_{pixel}$ is equal to sum of product of area $a_k$ and luminance of gray-level $X_k(V_k)$ of each display region. The overall luminance of gray-level variation $X_{pixel}$ is lower than the transmittance variation $X_0$.

In an embodiment of the invention, luminance of gray-level $L_k(V_k)$ of some parts of the display regions is greater than $L_{pixel}$, luminance of gray-level $L_k(V_k)$ of the other parts of the display regions is lower than $L_{pixel}$. In addition, liquid crystal voltages $V_k$ (i.e. $V_1, V_2, \ldots, V_{n-1}$, and $V_n$) applied to each of the display regions are different from one another, or not identical. It is noted that the driving method does not exclude applied identical liquid crystal voltages $V_k$ (i.e. $V_1, V_2, \ldots, V_{n-1}$, and $V_n$) to each of the display regions. In other words, the driving method which applied different liquid crystal voltages $V_k$ to each of the display regions and the driving method which applied identical liquid crystal voltages $V_k$ to each of the display regions can be adopted alternately when driving liquid crystal sub-pixels.

In an embodiment of the invention, areas $a_k$ (i.e. $a_1$, $a_2, \ldots, a_{n-1}$, and $a_n$) of each of the display regions are different from one another, identical, or not identical. Additionally, in the present embodiment, voltage-transmittance curve of liquid crystal layer within the display regions are different from one another, identical, or not identical.

When n=2 and a1≠a2, equation (3) and equation (4) are simplified as followings:

$$L_{pixel} = \frac{a_1 \times L_1(V_1) + a_2 \times L_1(V_2)}{a_1 + a_2} = \left(\frac{a_1}{a_1 + a_2}\right) \times L_1(V_1) + \left(\frac{a_2}{a_1 + a_2}\right) \times L_1(V_2)$$

$$X_{pixel} = \frac{a_1 \times X_1(V_1) + a_2 \times X_1(V_2)}{a_1 + a_2} = \left(\frac{a_1}{a_1 + a_2}\right) \times X_1(V_1) + \left(\frac{a_2}{a_1 + a_2}\right) \times X_1(V_2) < X_0$$

$$\frac{a_1}{a_1 + a_2} \text{ and } \frac{a_2}{a_1 + a_2}$$

represent area ratio of two display regions respectively, while $L_1(V_1)$ and $L_1(V_2)$ represent luminance of gray-level corresponding to liquid crystal voltage $V_1$ and liquid crystal voltage $V_2$ respectively.

When n=2 and a1=a2, equation (3) and equation (4) are further simplified as followings:

$$L_{pixel} = \frac{L_1(V_1) + L_1(V_2)}{2}$$

$$X_{pixel} = \frac{X_1(V_1) + X_1(V_2)}{2} < X_0$$

The Fourth Embodiment

Referring to equation (3) and equation (4) described in the third embodiment, when n=2, a1≠a2, and Voltage-luminance of gray level curves of display regions are not identical, equation (3) and equation (4) are simplified as followings:

$$L_{pixel} = \frac{a_1 \times L_1(V_1) + a_2 \times L_2(V_2)}{a_1 + a_2} = \left(\frac{a_1}{a_1 + a_2}\right) \times L_1(V_1) + \left(\frac{a_2}{a_1 + a_2}\right) \times L_2(V_2)$$

$$X_{pixel} = \frac{a_1 \times X_1(V_1) + a_2 \times X_2(V_2)}{a_1 + a_2} = \left(\frac{a_1}{a_1 + a_2}\right) \times X_1(V_1) + \left(\frac{a_2}{a_1 + a_2}\right) \times X_2(V_2) < X_0$$

$$\frac{a_1}{a_1 + a_2} \text{ and } \frac{a_2}{a_1 + a_2}$$

represent area ratio of two display regions respectively, while $L_1(V_1)$ and $L_2(V_2)$ represent luminance of gray-level corresponding to liquid crystal voltage $V_1$ and liquid crystal voltage $V_2$ respectively.

When n=2, a1=a2, and Voltage-Luminance of Gray level curves of display regions are not identical, equation (3) and equation (4) are further simplified as followings:

$$L_{pixel} = \frac{L_1(V_1) + L_2(V_2)}{2}$$

$$X_{pixel} = \frac{X_1(V_1) + X_2(V_2)}{2} < X_0$$

As shown in the present embodiment, Voltage-luminance of Gray level curves of display regions are not identical because structural designs of display regions are not identical. The concept of the present invention is still applied when Voltage-Transmittance curves of the liquid crystal layer in display regions are not identical.

By selecting liquid crystal voltages in accordance with the target luminance of gray-level (or the target transmittance) to be displayed and area ratio of each display region in the liquid crystal sub-pixel and applies each liquid crystal voltage to one of the display regions correspondingly, the liquid crystal sub-pixel of the present invention can effectively reduce image sticking problem.

Although the present invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A driving method of a liquid crystal sub-pixel, wherein a transmittance of the liquid crystal sub-pixel is $T_0$ when applying a bias voltage $V_0$ to the liquid crystal sub-pixel, a transmittance variation of the liquid crystal sub-pixel is So when the bias voltage $V_0$ is changed by a variation of liquid crystal voltage $\Delta V_{LC}$, and the driving method comprises:

dividing the liquid crystal sub-pixel into display regions in a number of n, n>2, and applying bias voltages $V_k$ respectively to the n display regions and 1<k<n, wherein at least one of the bias voltages $V_k$ is greater than the bias voltage $V_0$, and at least another one of the bias voltages $V_k$ is smaller than the bias voltage $V_0$, such that a transmittance of the liquid crystal sub-pixel divided into the n display regions is $T_{sub\text{-}pixel}$ satisfying equation (1) and equation (2);

wherein the equation (1) is:

$$T_0 = T_{sub\text{-}pixel} = \frac{\sum_{k=1}^{n} a_k \times T_k(V_k)}{\sum_{k=1}^{n} a_k}, \quad (1)$$

and wherein the equation (2) is:

$$S_{sub\text{-}pixel} = \frac{\sum_{k=1}^{n} a_k \times S_k(V_k)}{\sum_{k=1}^{n} a_k} < S_0, \quad (2)$$

wherein a transmittance of each of the display regions is $T_k(V_k)$, an area of each of the display regions is $a_k$, a transmittance variation in each of the display regions is $S_k(V_k)$, when the bias voltage $V_k$ in each of the display regions is changed by the variation of liquid crystal voltage $\Delta V_{LC}$, and a transmittance variation of the liquid crystal sub-pixel with n display regions is $S_{sub\text{-}pixel}$.

2. The driving method of claim 1, wherein the bias voltages $V_1, V_2, \ldots, V_{n-1}$, and $V_n$ applied to the display regions are different from one another.

3. The driving method of claim 1, wherein the areas $a_1, a_2, \ldots, a_{n-1}$, and $a_n$ of the display regions are different from one another.

4. The driving method of claim 1, wherein areas $a_1, a_2, \ldots, a_{n-1}$, and $a_n$ of the display regions are identical.

5. The driving method of claim 1, wherein the areas $a_1, a_2, \ldots, a_{n-1}$, and $a_n$ of the display regions are not identical.

6. The driving method of claim 1, wherein the transmittance $T_k(V_k)$ of at least one of the display regions is greater than $T_0$, and the transmittance $T_k(V_k)$ of at least another one of the display regions is lower than $T_0$.

7. The driving method of claim 1, wherein the liquid crystal sub-pixel comprises a transmissive liquid crystal sub-pixel, reflective liquid crystal sub-pixel, or a transflective liquid crystal sub-pixel.

8. The driving method of claim 1, wherein the voltage-transmittance curve of the display regions are different from one another.

9. The driving method of claim 1, wherein voltage-transmittance curves of the display regions are identical.

10. The driving method of claim 1, wherein voltage-transmittance curves of the display regions are not identical.

11. The driving method of claim 1, wherein the transmittance variation $S_k(V_k)$ of a corresponding one display region is lower than 0.0025/mV when the variation of liquid crystal voltage $\Delta V_{LC}$ is 1 mV.

12. A driving method of a liquid crystal sub-pixel, wherein a luminance of gray level of the liquid crystal sub-pixel is $L_0$ when applying a bias voltage $V_0$ to the liquid crystal sub-pixel, a luminance of gray level variation of the liquid crystal sub-pixel is $X_0$ when the bias voltage $V_0$ is changed by a variation of liquid crystal voltage $\Delta V_{LC}$, and the driving method comprises:

dividing the liquid crystal sub-pixel into display regions in a number of n, n>2, and applying bias voltages $V_k$ respectively to the display regions and 1<k<n, wherein at least one of the bias voltages $V_k$ is greater than the bias voltage $V_0$, and at least another one of the bias voltages $V_k$ is smaller than the bias voltage $V_0$, such that a luminance of gray level of the liquid crystal sub-pixel divided into the n display regions is $L_{sub\text{-}pixel}$ satisfying equation (1) and equation (2);

wherein the equation (1) is:

$$L_0 = L_{sub\text{-}pixel} = \frac{\sum_{k=1}^{n} a_k \times L_k(V_k)}{\sum_{k=1}^{n} a_k}, \quad (1)$$

and wherein the equation (2) is:

$$X_{sub\text{-}pixel} = \frac{\sum_{k=1}^{n} a_k \times X_k(V_k)}{\sum_{k=1}^{n} a_k} < X_0, \quad (2)$$

wherein a luminance of gray level of each display region is $L_k(V_k)$, an area of each of the display regions is $a_k$, a luminance of gray-level variation in each of the display regions is $X_k(V_k)$, when the bias voltage $V_k$ in each of the display regions is changed by the variation of liquid crystal voltage $\Delta V_{LC}$, and a luminance of gray-level variation of the liquid crystal sub-pixel with n display regions is $X_{sub\text{-}pixel}$.

13. The driving method of claim 12, wherein the bias voltages $V_1, V_2, \ldots, V_{n-1}$, and $V_n$ applied to the display regions are different from one another.

14. The driving method of claim 12, wherein the areas $a_1, a_2, \ldots, a_{n-1}$, and $a_n$ of the display regions are different from one another.

15. The driving method of claim 12, wherein the areas $a_1, a_2, \ldots, a_{n-1}$, and $a_n$ of the display regions are identical.

16. The driving method of claim 12, wherein the areas $a_1, a_2, \ldots, a_{n-1}$, and $a_n$ of the display regions are not identical.

17. The driving method of claim 12, wherein the luminance of gray-level $L_k(V_k)$ of one of the display regions is greater than $L_{pixel}$, and the luminance of gray-level $L_k(V_k)$ of another one of the display regions is lower than $L_{pixel}$.

18. The driving method of claim 12, wherein the liquid crystal sub-pixel comprises a transmissive liquid crystal sub-pixel, reflective liquid crystal sub-pixel, or a transflective liquid crystal sub-pixel.

19. The driving method of claim 12, wherein the voltage-luminance of gray level curve of the display regions are different from one another.

20. The driving method of claim 12, wherein voltage-luminance of gray level curves of the display regions are identical.

21. The driving method of claim 12, wherein voltage-luminance of gray level curves of the display regions are not identical.

* * * * *